US005367807A

United States Patent [19]

Van Beek

[11] Patent Number: 5,367,807

[45] Date of Patent: Nov. 29, 1994

[54] FLEXIBLE ADJUSTABLE SIGN SUPPORT AND METHOD OF USING SAME

[75] Inventor: Robert Van Beek, Paw Paw, Ill.

[73] Assignee: Academy Display, Inc., Westmont, Ill.

[21] Appl. No.: 173,912

[22] Filed: Dec. 23, 1993

Related U.S. Application Data

[63] Continuation of Ser. No. 937,471, Aug. 28, 1992, abandoned.

[51] Int. Cl.[5] ..... G09F 15/00

[52] U.S. Cl. ..... 40/606; 40/613

[58] Field of Search ..... 40/124.1, 584, 606, 40/613, 617, 649; 248/629

[56] References Cited

U.S. PATENT DOCUMENTS

| | | | |
|---|---|---|---|
| 233,958 | 11/1880 | Westmore . | |
| 1,224,582 | 5/1917 | Vandegrift . | |
| 2,130,945 | 9/1938 | Brownwell | 40/659 |
| 2,133,824 | 10/1938 | Meisel . | |
| 2,895,246 | 7/1959 | Menges . | |
| 2,981,018 | 4/1961 | Hopp et al. . | |
| 3,774,328 | 11/1973 | Tanney . | |
| 4,009,532 | 3/1977 | Thomas | 40/606 X |
| 4,167,073 | 9/1979 | Tang | 40/124.1 |
| 4,352,461 | 10/1982 | Orta et al. . | |
| 4,583,308 | 4/1986 | Taub | 40/642 X |

*Primary Examiner*—Kenneth J. Dorner
*Assistant Examiner*—Joanne Silbermann

[57] ABSTRACT

A support apparatus (10) having a base (14) from which a sign member (16) is suspended having a flexible member (18) in which the sign member (16) is secured (20) to the flexible member (18) and in which an adjustable engagement (26) is secured to the base (14) and spaced apart from the securement of the sign member (16) to the flexible member (18) to adjustably engage the flexible member (18) to position the sign member (16) to a desired distance from the base (14), as well as a method of using the same. It further includes a flexible member (18) in which a sign member (16) is secured to flexible member (18) and providing a support (40) for the flexible member (18) at a location spaced apart from the securement of the sign member (16) in which the sign member (16) and a portion (42) of the flexible member (18) between the support (40) and the sign member (16) are displaceable relative to the support (40).

21 Claims, 1 Drawing Sheet

Fig. 1
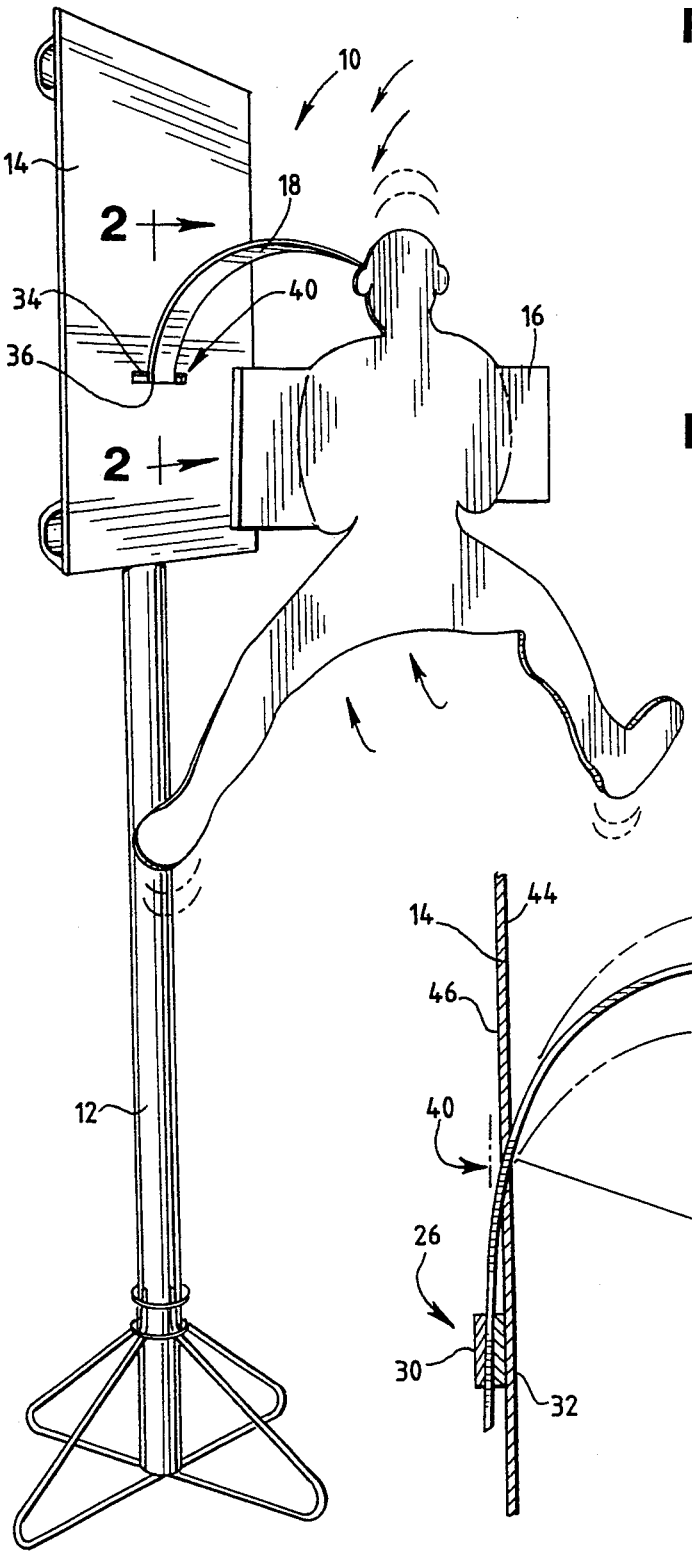
Fig. 4
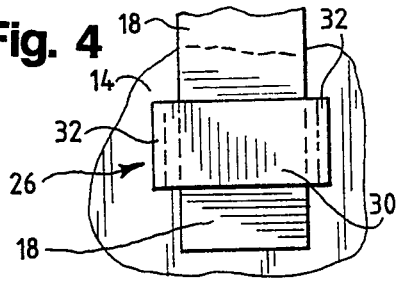
Fig. 3
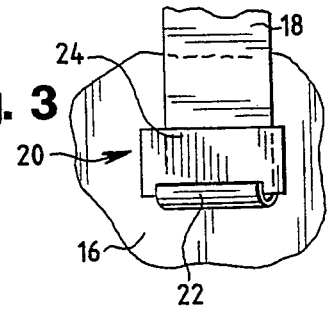
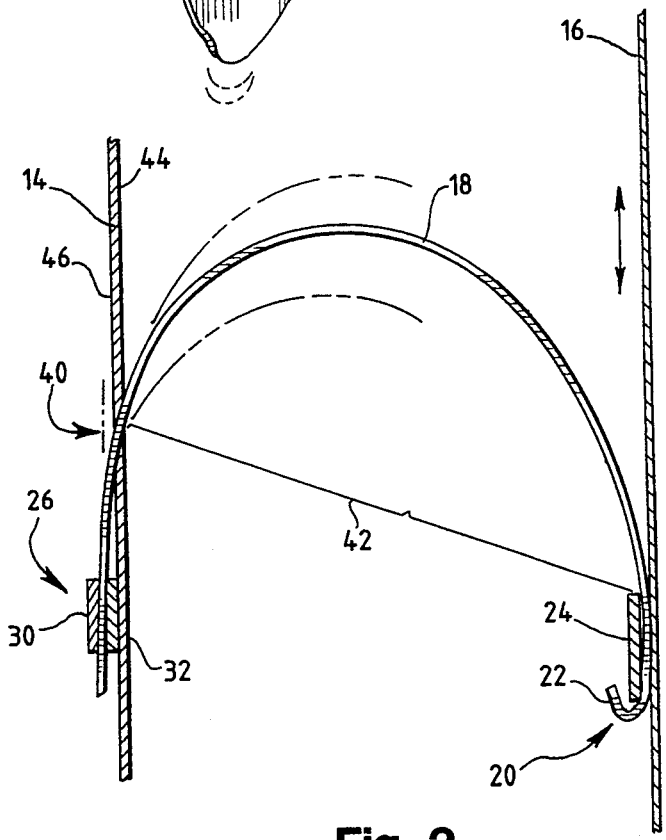
Fig. 2

FLEXIBLE ADJUSTABLE SIGN SUPPORT AND METHOD OF USING SAME

This application is a continuation of application Ser. No. 07/937,471, filed Aug. 28, 1992, now abandoned.

BACKGROUND OF THE INVENTION

1. Field of the Invention

The present invention relates generally to a support for a sign, and more particularly to a flexible support which is adjustable in length and a method for using the same.

2. Description of the Related Art Including Information Disclosed Under 37 CFR 1.97–1.99

In the sale of merchandise through retail outlets, it is desirable to advertise an item offered for sale to attract customers attention to the item in order to sell more of that item. Thus, when advertising products, it is of advantage to display descriptive information to indicate the item being sold in order to attract the customers attention.

Since items for purchase are located on shelves and in bins of various configurations, a variety of advertising apparatuses have been developed to attract customers attention to the items being sold. Advertising apparatuses of the type having a flexible member and ways of securing the flexible member to a sign member are well known. However, none of the advertising apparatuses provide means for adjustably engaging the flexible member to position a sign member to a desired distance from the base. This can be seen in U.S. Pat. No. 4,352,461, to Orta et el. issued Oct. 5, 1982; U.S. Pat. No. 2,895,246, to Mengee issued Jul. 21, 1959; U.S. Pat. No. 2,133,824, to Meisel issued Oct. 18, 1938; U.S. Pat. No. 1,224,582, to Vandergrift issued May 1, 1917; and U.S. Pat. No. 233,958 to Wetmore issued Nov. 2, 1880.

U.S. Pat. No. 3,774,328, to Tanney issued Nov. 27, 1973; U.S. Pat. No. 2,981,018 to Hoppet el. issued Apr. 15, 1961; U.S. Pat. No. 1,772,126 to Kelsea issued Jul. 22, 1930; and British Patent No. 1,220,674 to Pegg issued Jan. 27, 1968, provide for a flexible member and means for securing the flexible member to the sign member and a support member secured to the base. However, the support member in each of the above stated patents does not adjustably engage the flexible member to position the sign member to a desired distance from the base. In other words, the sign member is not adjustable in distance relative to the base.

Additionally, none of the above stated patents provide a method for engaging at least a portion of the flexible member to an adjustable engagement secured to the base at a desired position along the flexible member to position the sign member to a desired distance from the base. In other words, no method is provided for engaging the sign member in adjustable positions from the base.

Furthermore, none of the advertising apparatuses provide for means of supporting the flexible member at a location spaced apart from the securing means in which the sign member and a portion of the flexible member between the supporting means and the sign member are rotatable relative to the supporting means. This can be seen in U.S. Pat. No. 2,981,018 to Ropp et al. issued Apr. 15, 1961; U.S. Pat. No. 2,895,246, to Menges issued Jul. 21, 1959; U.S. Pat. No. 2,133,824, to Meisel issued Oct. 18, 1938; U.S. Pat. No. 1,224,582, to Vandergrift issued May 1, 1917; U.S. Pat. No. 233,958 to Wetmore issued Nov. 2, 1880; U.S. Pat. No. 3,774,328 to Tanney issued Nov. 27, 1973; U.S. Pat. No. 4,352,461, to Orta et al. issued Oct. 5, 1982; and British Pat. No. 1,220,674 to Pegg issued Jan. 27, 1968.

In U.S. Pat. No. 1,772,126 to Kelsea issued Jul. 22, 1930, does not provide for supporting means of the flexible member at a location spaced apart from the securing means, in which the sign member and a portion of the flexible member between the supporting means and the sign member are rotatable relative to the supporting means.

SUMMARY OF THE INVENTION

It is therefore an object of this invention to provide a support apparatus having a base from which a sign member is suspended having a flexible member in which the sign member is secured to the flexible member and in which an adjustable engagement is secured to the base and spaced apart from the securement of the sign member to the flexible member to adjustably engage the flexible member to position the sign member to a desired distance from the base.

It is a further objective of this invention to provide a support apparatus having a base from which a sign member is suspended having a flexible member and securing the sign member to the flexible member and supporting the flexible member at a location spaced apart from the securement of the sign member to the flexible member in which the sign member and a portion of the flexible member between supporting the flexible member and the sign member are displaceable relative to supporting the flexible member.

It is a further objective of this invention to provide a method for suspending a sign member from a base with a flexible member having the steps of securing the sign member to the flexible member and adjustably engaging the flexible member at a desired position along the flexible member for adjustably engaging the flexible member in which the adjustable engagement is secured to the base, to position the sign member to a desired distance from the base.

It is a further objective of this invention to provide a method for suspending a sign member from a base with a flexible member having the steps of securing the sign member to the flexible member and supporting the flexible member at a location on the flexible member spaced apart from the sign member permitting the flexible member from the location to the sign member to be displaceable relative to the location.

BRIEF DESCRIPTION OF DRAWING

The foregoing objects and advantageous features of the invention will be explained in greater detail and others will be made apparent from the detailed description of the preferred embodiment of the present invention which is given reference to the several figures of the drawing, in which:

FIG. 1 is a perspective view of the support apparatus;

FIG. 2 is a cross sectional view along line 2—2 seen in FIG. 1;

FIG. 3 is a partial perspective view of securing means; and

FIG. 4 is a partial perspective view of adjustably engaging means.

DETAILED DESCRIPTION

Referring now to the drawings, support apparatus 10 can be seen in FIG. 1, installed in a typical store where items are sold. This apparatus will typically be a point of sale advertisement to attract the customer's attention to the item being sold. As seen in FIG. 1, a typical structure may find a stand 12 supporting base 14 from which sign member 16 is suspended. The support apparatus also includes flexible member 18, and means for securing 20 sign member 16 to flexible member 18. Securing means 20 can come in many configurations, shapes and forms. A mere sample of such configurations is seen in FIG. 2.

Referring now to FIGS. 2 and 3, securing means 20 typically includes flexible member 18 having hook member 22 disposed on flexible member 18 and sign member 16 having cross member 24 secured to sign member 16 in which hook member 22 and cross member 24 releasably engage.

In keeping with the object of the invention, flexible member 18 is elongate, or any suitable shape known in the art. Flexible member 18 is plastic, metal or any suitable material known in the art that will provide flexibility. More desirable materials will provide oscillatory movement of sign member 16 caused by the movement of ambient air against sign member 16.

Referring now to FIGS. 2 and 4, support apparatus 10 includes means for adjustably engaging 26 flexible member 18 secured to base 14 and spaced apart from securing means 20 which will position sign member 16 to a desired distance from base 14. As flexible member 18 is secured in different locations with engaging means 26 the length of flexible member 18 extending from base 14 to sign member 16 will vary accordingly. Further, typically sign member 16 will rise as the length of the flexible member 18 extending from base 14 shortens, and typically lowers as the length increases. In addition, for a flexible member 18 the frequency of the movement of sign member 14 will increase as the length of flexible member 18 decreases and decrease as the length increases. As can be seen from the present invention the position of sign member 16 and the movement of sign member 16 can be changed by altering the length of flexible member 18 extending from base 14. The adjustably engaging means 26 can come in many configurations, shapes and forms. A mere sample of such configurations is seen in FIGS. 2 and 4.

In keeping the object of the invention, adjustably engaging means 26 includes wall member 30 spaced apart from base 14 in which wall member 30 is secured to base 14 to maintain at least a portion of flexible member 18 between wall member 30 and base 14. In numerous common ways of securing wall member 30 to base 14, an example has been shown in FIGS. 2 and 4 of wall 32 being transverse and secured to base 14 and wall member 30, thereby providing spacing between base 14 and wall member 30 through which flexible member 18 snugly fits through. Another of such numerous ways of providing spaced wall member 30 from base 14 would be to provide a cross member similarly shown in FIG. 3. This type of structure is one of many ways of engaging flexible member 18 in various locations and thereby adjusting the length of flexible member 18 extending beyond base 14. Keep in mind adjustably engaging means is secured typically to base 14 anywhere including the front section 44, back portion 46 or edge thereof, etc.

In keeping the object of the invention, support apparatus 10 includes means for supporting 40 flexible member 18 at a location between adjustably engaging means 26 and securing means 20 in which sign member 16 and portion 42 of the flexible member 18 between the supporting means 40 and the sign member 16 are displaceable relative to supporting means 40. Flexible member 18 will typically oscillate based on ambient air movement imparting forces on sign member 16.

Supporting means 40 can include an opening, such as slot 34, or openings of other configurations, in base 14. Flexible member 18 passes through the opening 34 in which at least a portion 36 of base 14 that defines opening 34 engages flexible member 18 as it rests upon portion 36.

In keeping the object of the invention, supporting means 40 does not have to include an opening 34 in base 14. Rather, the flexible member 18 can pass over top of the base 14 and in which at least a portion of the top of base 14 engages the flexible member 18 or any other similar support.

In keeping the object of the invention, supporting means 40 could also include a support that is not secured to base 14 which would engage flexible member 18.

In keeping with this invention a method for suspending sign member 16 from base 14 with flexible member 18 is provided comprising the steps of securing sign member 16 to flexible member 18 and adjustably engaging flexible member 18 at a desired position along flexible member 18 with adjustably engaging means 26 in which adjustably engaging means 26 is secured to base 14 to position sign member 14 to a desired distance from base 14. Further, this method includes the step of supporting flexible member 18 at a location, such as opening 34 and portion 36 of base 14, between adjustably engaging means 26 and sign member 16 permitting flexible member 18 from the location to sign member 16 to displace relative to the location. Such displacement, as may be appreciated, will vary depending on the composition of flexible member 18, the length of flexible member 18 extending from the location to sign member 16 as well as the forces imparted upon sign member 16.

It is a further object of this invention to provide a method for suspending sign member 16 from base 14 with flexible member 18 comprising the steps of securing sign member 16 to flexible member 18 and supporting flexible member 18 at a location, such as described above, on flexible member 18 spaced from sign member 16 permitting flexible member 18 from the location to sign member 16 to displace relative to the location. Similarly, this method includes the step of adjustably engaging flexible member 18 at a desired position along flexible member 18 with adjustably engaging means 26 in which engaging means 26 is secured to base 14 to position sign member 16 to a desired distance from base 14.

While a preferred embodiment has been disclosed, it should be appreciated that the scope of the invention is defined in the appended claims.

I claim:

1. A support apparatus having a base from which a sign member is suspended, comprising:

a flexible member;

means for securing the sign member to the flexible member; and means for continuously adjustably engaging the flexible member at any position along the length of the flexible member secured to the base and spaced apart from the securing means in which the adjustable engaging means includes a wall member spaced apart from the base and in which the wall member is secured to the base to maintain at least a portion of the flexible member between the wall member and the base, to position the sign member to any distance from the base.

2. The support apparatus of claim 1 in which said flexible member is elongate.

3. The support apparatus of claim 1 in which said flexible member is plastic.

4. The support apparatus of claim 1 in which said flexible member is metal.

5. The support apparatus of claim i in which the securing means includes the flexible member having a hook member disposed on the flexible member and the sign member having a cross member secured to the sign member in which the hook member and the cross member releasably engage.

6. The support apparatus of claim 1 includes a wall transverse and secured to the base and the wall member.

7. A support apparatus having a base from which a sign member is suspended, comprising:

a flexible member;

means for securing the sign member to the flexible member;

means for continuously adjustably engaging the flexible member at any position along the length of the flexible member secured to the base and spaced apart from the securing means to adjustably position the sign member to any distance from the base; and means for supporting the flexible member at a location between said adjustable engaging means and securing means in which the sign member and a portion of the flexible member between the adjustable engaging means and the sign member are displaceable relative to the supporting means.

8. The support apparatus of claim 7 in which the supporting means includes an opening in the base in which the flexible member passes through the opening and in which at least a portion of the base that defines the opening engages the flexible member.

9. The support apparatus of claim 8 in which said opening is a slot.

10. A support apparatus having a base from which a sign member is suspended, comprising:

a flexible member secured to the base at a first location;

means for securing the sign member to the flexible member; and means for supporting the flexible member at a second location intermediate and spaced apart from the securing means and the first location which includes an opening in the base through which the flexible member passes through and in which a portion of the base which defines the opening engages the flexible member in which the sign member and a portion of the flexible member between the supporting means and the sign member are displaceable relative to the supporting means.

11. The support apparatus of claim 10 in which said flexible member is elongate.

12. The support apparatus of claim 10 in which said flexible member is plastic.

13. The support apparatus of claim 10 in which said flexible member is metal.

14. The support apparatus of claim 10 in which the securing means includes the flexible member having a hook member disposed on the flexible member and the sign member having a cross member secured to the sign member in which the hook member and the cross member releasably engage.

15. The support apparatus of claim 10 includes means for adjustably engaging the flexible member, secured to the base and spaced apart from the securing means, to position the sign member to a desired distance from the base.

16. The support apparatus of claim 15 in which said adjustable engaging means includes a wall member spaced apart from the base in which the wall member is secured to the base to maintain at least a portion of the flexible member between the wall member and the base.

17. The support apparatus of claim 16 in which the wall member is secured to the base member with a wall transverse and secured to the base and the wall member.

18. The support apparatus of claim 10 in which said opening is a slot.

19. A method for suspending a sign member from a base with a flexible member, comprising the steps of:

securing the sign member to the flexible member at a first location; and adjustably engaging the flexible member at any continuous position along the length of the flexible member with means for adjustably engaging the flexible member, in which the engaging means is secured to the base, to adjustably position the sign member to any distance from the base; and supporting the flexible member at a second location between the adjustable engaging means and the first location permitting the flexible member from the second location to the first location to displace relative to the location.

20. A method for suspending a sign member from a base with a flexible member, comprising the steps of:

securing the sign member to the flexible member; and supporting the flexible member at a location on the flexible member spaced from the sign member and the base in which the flexible member is passed through an opening in the base in which a portion of the base which defines the opening engages the flexible member permitting the flexible member from the location in which the flexible member engages the portion of the base which defines the opening to the sign member to displace relative to the portion of the base which defines the opening.

21. The method of claim 20 includes the step of adjustably engaging the flexible member at a desired position along the flexible member with means for adjustably engaging the flexible member, in which the engaging means is secured to the base, to position the sign member to a desired distance from the base.

* * * * *

UNITED STATES PATENT AND TRADEMARK OFFICE

CERTIFICATE OF CORRECTION

PATENT NO. : 5,367,807

DATED : November 29, 1994

INVENTOR(S) : Robert Van Beek

It is certified that error appears in the above-identified patent and that said Letters Patent is hereby corrected as shown below:

On the title page: Item [56] Reference Cited:

change "Westmore" to --Wetmore--
change "Brownwell" to --Brownell--

Col. 1, line 34, change "Mengee" to --Menges--
Col. 1, line 39, change "Hoppet el." to --Hopp et al.--
Col. 1, line 64, change "Ropp" to --Hopp--
Col. 5, line 11, after "claim" delete "i" and insert --1--

Signed and Sealed this

Twenty-first Day of February, 1995

*Attest:*

Bruce Lehman

BRUCE LEHMAN

*Attesting Officer*

*Commissioner of Patents and Trademarks*